US006939839B2

(12) United States Patent
Johnson

(10) Patent No.: US 6,939,839 B2
(45) Date of Patent: Sep. 6, 2005

(54) CLEANING COMPOSITION WITH TERPENE AND HYDROGEN PEROXIDE

(76) Inventor: Louis B. Johnson, P.O. Box 381, Troy, AL (US) 36081

( * ) Notice: Subject to any disclaimer, the term of this patent is extended or adjusted under 35 U.S.C. 154(b) by 0 days.

(21) Appl. No.: 10/704,706

(22) Filed: Nov. 12, 2003

(65) Prior Publication Data

US 2004/0180804 A1 Sep. 16, 2004

Related U.S. Application Data

(60) Provisional application No. 60/453,203, filed on Mar. 11, 2003.

(51) Int. Cl.[7] ..... C11D 17/00

(52) U.S. Cl. ..... 510/372; 510/375; 510/417; 510/424; 510/426; 510/463

(58) Field of Search ..... 510/424, 426, 510/417, 372, 375, 407, 463

(56) References Cited

U.S. PATENT DOCUMENTS 6,316,399 B1 11/2001 Melikyan et al.

*Primary Examiner*—Necholus Ogden
(74) *Attorney, Agent, or Firm*—Clark & Brody

(57) ABSTRACT

A cleaning composition uses a terpene such as D-limonene or orange oil, a nonionic surfactant, a single anionic surfactant, an anti-oxidant, hydrogen peroxide, and the balance deionized water.

12 Claims, No Drawings

CLEANING COMPOSITION WITH TERPENE AND HYDROGEN PEROXIDE

This application claims priority under 35 USC 119(e) based on provisional patent application No. 60/453,203 filed on Mar. 11, 2003.

FIELD OF THE INVENTION

The present invention is directed to a cleaning composition, and in particular, to a composition containing a terpene, hydrogen peroxide, and a reduced amount of surfactant.

BACKGROUND ART

In the prior art, hydrogen peroxide is a desirable component of cleaning preparations. However, it is also an unstable compound, and its use in a cleaning composition requires fine tuning in order that the composition remain stable over time, and that hydrogen peroxide does not break down.

One such composition is disclosed in U.S. Pat. No. 6,316,399 to Melikyan et al. This patent discloses a composition combining a terpene such as D-limonene and hydrogen peroxide and a number of surfactants. The aim of this patent is to provide a composition that has high stability over long periods of time. This aim is accomplished by using a terpene, an anti-oxidant, two anionic surfactants, a non-ionic surfactant, hydrogen peroxide, and Deionized water. One of the anionic surfactants acts as an emulsifier, and a cleaning surfactant, whereas the other anionic surfactant acts as a wetting agent, surface tension reducer, and hydrotrope.

While the composition of the Melikyan et al. patent is described as having stability, it suffers from a high loading of surfactants. The loadings tend to leave a sticky residue on the material being treated and this stickiness contributes to resoiling of the treated area.

Thus, a need exists to provide improved hydrogen peroxide-containing cleaning compositions which are both stable over long periods of time, and do not cause rapid resoiling of the areas treated with the composition.

The present invention responds to this need by the discovery of a cleaning composition that is both stable and is more resistant to resoiling by virtue of a lower surfactant loading.

SUMMARY OF THE INVENTION

It is a first object of the present invention to provide an improved cleaning composition that uses a terpene such as D-limonene or orange oil.

Another object of the invention is a method of using the composition in a variety of strengths.

Other objects and advantages of the present invention will become apparent as a description thereof proceeds.

In satisfaction of the foregoing objects and advantages, the present invention provides an improved cleaning composition consisting essentially of a terpene in an amount ranging between 0.01–30.0% by weight; an anti-oxidant in a finite amount between zero and 4.0% by weight; a water soluble co-solvent between zero and up to 10.0% by weight; a single anionic surfactant, either an alkali metal salt of a linear alkylbenzene sulfonic acid in an amount corresponding to 1.2 parts per 1.0 part of the terpene component, or an alkali metal salt of an alkyl sulfonate in an amount of 0.8 parts per 1.0 part of the terpene component; a non-ionic surfactant in an amount between 0.5 and 7.0% by weight; hydrogen peroxide in an amount between 2.0–75.0% by weight, wherein the hydrogen peroxide amount is based on a solution of 35% concentration; a thickener from zero and up to 5.0% by weight; and the balance deionized water.

The single anionic surfactant can be either the alkali metal salt of a linear alkylbenzene sulfonic acid or the alkali metal salt of an alkyl sulfonate. When using the alkali metal salt of a linear alkylbenzene sulfonic acid, it is preferably an isopropylamine salt of a linear alkylbenzene sulfonic acid. When using the alkali metal salt of an alkyl sulfonate, it is preferably sodium 1-octane sulfonate.

The terpene is preferably an orange oil or D-limonene. When using a co-solvent, a glycol ether such as ethylene glycol monobutyl ether can be used in effective amounts. The nonionic surfactant is preferably an alcohol ethoxylate.

DESCRIPTION OF THE PREFERRED EMBODIMENTS

The present invention is an improvement in cleaning compositions using a terpene and hydrogen peroxide. The inventor has discovered that a stable and effective composition can be made by the use of a single anionic surfactant in combination with a nonionic surfactant, an anti-oxidant, a terpene, hydrogen peroxide, and deionized water. In certain formulations, due to a high amount of hydrogen peroxide, the deionized water component may be zero. The formulation can also employ an additional solvent and a thickener.

The following table outlines the components of the composition, in terms of weight percent of the compositional solution.

TABLE 1

| Components | range in weight percent of component based on entire solution weight as shown in Johnson formulation |
|---|---|
| a terpene[1], including D-limonene and orange oils | 0.01–30.0% |
| an anti-oxidant[2] | a finite amount between zero and 4.0% |
| a water soluble co-solvent[3] | zero and up to 10.0% |
| one anionic surfactant only, either an A type or B type anionic surfactant[4] | 1.2 parts of the A-type to 1.0 part of the terpene component or 0.8 parts of the B-type to 1.0 part of the terpene component |
| non-ionic surfactant[5] | 0.5–7.0% |
| hydrogen peroxide (35%) | 2.0–75.0% |
| a thickener[6] | zero and up to 5.0% |
| deionized water | balance to make 100% |

[1]The terpene is defined as a terpene hydrocarbon, and may be a monoterpene or sesquiterpene, or a combination of both. The terpene may be acyclic, monocyclic, or bicyclic.
[2]The anti-oxidant is a food grade anti-oxidant such as butylated hydroxy anisole blend with other materials.
[3]The water soluble co-solvent can be a glycol ether such as ethylene glycol monobutyl ether.
[4]The A type surfactant is an alkali metal salt of a linear alkylbenzene sulfonic acid. The B type surfactant is an alkali metal salt of an alkyl sulfonate.
[5]The non-ionic surfactant is an alcohol ethoxylate.
[6]The thickener can be a polyacrylate-polyalcohol polymer or an equivalent thereto, with one commercial type being THIX.

More details of the surfactants is as follows:

One of the Type A or B Anionic Surfactants

One preferred surfactant as Type A is an isopropylamine salt of the linear alkylbenzene sulfonic acid. A preferred Type B anionic surfactant is sodium 1-octane sulfonate.

One commercial formulation of the Type A surfactant listed above is BIOSOFT-411. This type A surfactant is available from a number of suppliers, e.g. Stepan, and is also sold under a different trade name but still identified as a match with BIOSOFT-411. Likewise, one commercial formulations of the Type B surfactant is Bioterge PAS-8S and this is available from one or more suppliers, either under this trade name or under another trade name known to be an equivalent to Bioterge PAS-8S.

Nonionic Surfactant

The nonionic surfactant can have its number of carbon atoms vary, with a preferred range being between 10–15 carbon atoms. A preferred HLB value is 13.1. In this regard, one commercial formulation for this type of surfactant is Neodol 25-9, which is available from a number of suppliers, whose identities can be obtained by using the world wide web. Other commercial formulations under different trade names are also available as an equivalent to Neodol 25-9.

A key aspect of the invention is the ability to use a single anionic surfactant to maintain the stability of the composition, as opposed to having first and second anionic surfactants as is required in the Melikyan et al. patent.

While Table 1 above outlines the limits of the invention, specific formulations are detailed below in TABLE 2.

TABLE 2

| component | wt. % | | | | | | | | | |
|---|---|---|---|---|---|---|---|---|---|---|
| deionized water | 55.36 | 58.17 | 93.06 | 93.59 | 0.00 | 0.00 | 49.89 | 93.89 | 94.11 | 92.69 |
| anti-oxidant | 0.02 | 0.02 | 0.02 | 0.02 | 0.02 | 0.02 | 0.02 | 0.02 | 0.02 | 0.02 |
| glycol ether | 0.00 | 0.00 | 0.00 | 0.00 | 0.00 | 0.00 | 7.00 | 0.58 | 0.58 | 0.58 |
| D-limonene | 7.08 | 7.08 | 1.32 | 1.32 | 7.08 | 7.08 | 6.58 | 0.55 | 0.55 | 0.55 |
| Biosoft-411 | 8.55 | 0.00 | 1.60 | 0.00 | 8.55 | 0.00 | 7.95 | 0.66 | 0.00 | 0.66 |
| Bioterge PAS-8S | 0.00 | 5.74 | 0.00 | 1.07 | 00.0 | 5.74 | 0.00 | 0.00 | 0.44 | 0.00 |
| Neodol 25-9 | 6.41 | 6.44 | 0.00 | 1.07 | 6.41 | 6.41 | 5.96 | 0.50 | 0.50 | 0.50 |
| thickener | 0.00 | 0.00 | 0.00 | 0.00 | 0.00 | 0.00 | 0.00 | 0.00 | 1.00 | 1.00 |
| hydrogen peroxide (35%) | 22.6 | 22.6 | 2.80 | 2.80 | 72.2 | 72.2 | 22.6 | 2.80 | 2.80 | 4.00 |

It should also be understood that this disclosure incorporates by reference the Melikyan et al. patent discussed above. In this regard, the Melikyan patent discloses a number of different concentration levels for different uses in Table 2 thereof, and any of the uses would be applicable with any of the inventive formulations encompassed by Table 1 or the specifics ones of Table 2 of the instant application.

As noted in the Table 1 and 2 above, the hydrogen peroxide is preferred in a 35% concentration.

The thickener is an optional component of the formulation as is the co-solvent. A preferred co-solvent is a glycol ether, more preferably an ethylene glycol monobutyl ether or an equivalent thereto, since these types are effective in removing organic and petroleum soils as a result of the ether linkage.

The cleaning composition can be used virtually for any cleaning use, either for the consumer or in the industrial area. The uses include those known uses disclosed in Table 2 of the Melikyan patent, and any other known uses where cleaning, degreasing, odor and/or mildew elimination, disinfection, and stain removal are needed.

As such an invention has been disclosed in terms of preferred embodiments thereof, which fulfills each and every one of the objects of the invention as set forth above, and provides an improved cleaning composition.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A cleaning composition consisting of:

a terpene in an amount ranging between 0.01 and 30.0% by weight;

an anti-oxidant in a finite amount between zero and 4.0% by weight;

a water soluble co-solvent between zero and up to 10.0% by weight;

a single anionic surfactant selected from the group consisting of an alkali metal salt of a linear alkylbenzene sulfonic acid in an amount corresponding to 1.2 parts per 1.0 part of the terpene component and an alkali metal salt of an alkyl sulfonate in an amount of 0.8 parts per 1.0 part of the terpene component;

a non-ionic surfactant in an amount between 0.5 and 7.0% by weight;

hydrogen peroxide in an amount between 2.0–75.0% by weight, wherein the hydrogen peroxide amount is based on a solution of 35% concentration; a thickener from zero and up to 5.0% by weight; and the balance deionized water.

2. The cleaning composition of claim 1, wherein the single anionic surfactant is the alkali metal salt of a linear alkylbenzene sulfonic acid.

3. The cleaning composition of claim 1, wherein the single anionic surfactant is the alkali metal salt of an alkyl sulfonate.

4. The cleaning composition of claim 2, wherein the alkali metal salt of a linear alkylbenzene sulfonic acid is an isopropylamine salt of a linear alkylbenzene sulfonic acid.

5. The cleaning composition of claim 3, wherein the alkali metal salt of an alkyl sulfonate is sodium 1-octane sulfonate.

6. The cleaning composition of claim 1, wherein the terpene is D-limonene.

7. The cleaning composition of claim 1, further comprising glycol ether as the co-solvent in effective amounts.

8. The cleaning composition of claim 1, wherein the nonionic surfactant is an alcohol ethoxylate.

9. The cleaning composition of claim 1, wherein the anti-oxidant is a food grade anti-oxidant.

10. A cleaning composition consisting of:

D-limonene in an amount ranging between 0.55 and 7.08% by weight;

an anti-oxidant in a finite amount up to 0.02% by weight;

a single anionic surfactant selected from the group consisting of an isopropylamine salt of a linear alkylbenzene sulfonic acid in an amount corresponding to 1.2 parts per 1.0 part of the terpene component and sodium 1-octane sulfonate in an amount of 0.8 parts per 1.0 part of the terpene component;

alcohol ethoxylate in an amount between 0.5 and 7.0% by weight;

hydrogen peroxide in an amount between 2.8–72.2% by weight, wherein the hydrogen peroxide amount is based on a solution of 35% concentration; and the balance deionized water.

11. The cleaning composition of claim 1, wherein the anionic surfactant is the isopropylamine salt of a linear alkylbenzene sulfonic acid.

12. The cleaning composition of claim 1, wherein the anionic surfactant is sodium 1-octane sulfonate.

* * * * *